United States Patent [19]

Munson

[11] 4,400,766

[45] Aug. 23, 1983

[54] INSULATION DAMMING DEVICE

[75] Inventor: Richard W. Munson, Minnetonka, Minn.

[73] Assignee: Low Energy Homes, Inc., Minnetonka, Minn.

[21] Appl. No.: 222,465

[22] Filed: Jan. 5, 1981

[51] Int. Cl.[3] ..... F21V 15/00

[52] U.S. Cl. ..... 362/376; 362/365; 362/378; 362/294; 362/408; 52/580; 52/588; 52/221

[58] Field of Search ..... 52/578-581, 52/588, 593, 700, 221; 362/368, 312, 363, 5, 376, 406, 408, 378, 294

[56] References Cited

U.S. PATENT DOCUMENTS

| | | | |
|---|---|---|---|
| 2,517,979 | 8/1950 | Collins | 52/700 X |
| 3,112,891 | 12/1963 | Cutler | 362/373 X |
| 3,417,191 | 12/1968 | Fork | 52/221 X |
| 4,031,279 | 6/1977 | Cremer et al. | 52/580 X |
| 4,168,596 | 9/1979 | Yoder, Jr. | 52/588 X |
| 4,237,671 | 12/1980 | Munson . | |
| 4,280,307 | 7/1981 | Griffin | 52/580 X |
| 4,324,825 | 4/1982 | Denkinger | 52/588 X |

OTHER PUBLICATIONS

Insulshield Brochure (provided by Applicant).

*Primary Examiner*—Peter A. Nelson
*Attorney, Agent, or Firm*—Wicks & Nemer

[57] ABSTRACT

A device for damming insulation around and away from a heat producing object such as a recessed light fixture is disclosed in its preferred form according to the teachings of the present invention. Specifically, the insulation damming device is formed by the interconnection of one or more insulation damming members to form an enclosure of a size and shape arranged to fit around the heat producing object. The damming members are generally planar and are formed in the preferred embodiment of sheet metal. Top, middle, and bottom extension members extend from the first end edge of the damming member and positively interconnect with top, middle, and bottom series of slots extending along the length of the damming member from the second end edge of the damming member. To increase stability and position retention, apertures are formed in the damming member adjacent the bottom edge for receiving a wire for attachment to a support member. Thus, the damming member can be easily and quickly formed into an enclosure having a perimeter less than, substantially equal to, or greater than the standard sold length of the damming member allowing the fast, versatile, and easy installation of the insulation damming device without the necessary of tools or without cutting the damming member.

8 Claims, 5 Drawing Figures

INSULATION DAMMING DEVICE

BACKGROUND

This invention relates generally to devices for damming insulation around and away from heat producing objects.

With the increasing awareness of the efficient utilization of our energy resources, methods of conserving those energy resources have been given prime attention. Insulating buildings to prevent heat transfer between the inside and the outside environments has played a major role in conserving energy. However, insulation installed over a heat producing object, such as a recessed light fixture, may entrap heat and result in a fire. Thus, a need has arisen for a device for damming insulation around and away from heat producing objects such as recessed light fixtures.

Past attempts to satisfy that need include devices utilizing metal clips which attach the edges of panel members together. These clips were easy to loose and did not provide connection at the vertical middle of the device such that the devices were prone to bulge in the center allowing insulation to escape into the device and contact the heat producing object. Furthermore, prior devices were unable to fit around any size heat producing objects, required cutting of the device, and/or were unable to be easily shaped to fit around any shape of heat producing object.

SUMMARY

The present invention solves these and other problems of insulation damming devices by providing, in the preferred embodiment, at least a first insulation damming member. The insulation damming member is generally planar or sheetlike and includes members integrally formed therewith for interconnecting the damming member together to form an enclosure of a size to fit around a heat producing object substantially without the necessity of tools or without cutting of the damming member. Thus, the insulation damming member can be easily and quickly formed into an enclosure having a perimeter of various sizes, thus allowing its fast, versatile, and easy installation.

It is thus an object of the present invention to provide a novel device for damming insulation.

It is further an object of the present invention to provide such a novel device for damming insulation which allows fast, versatile, low cost, and easy installation.

It is further an object of the present invention to provide such a novel device for damming insulation which is safe to use with all types of insulation.

It is further an object of the present invention to provide such a novel device for damming insulation which meets all building code requirements for minimum clearance around heat producing objects.

It is further an object of the present invention to provide such a novel device for damming insulation which can be fit around any size or shape of heat producing object.

It is further an object of the present invention to provide such a novel device for damming insulation which prevents insulation from "bulging" in at the vertical center of the device.

It is further an object of the present invention to provide such a novel device for damming insulation which can be used in new construction, remodelling, or retrofit applications.

It is further an object of the present invention to provide such a novel device for damming insulation which includes an integral positive interlock.

It is further an object of the present invention to provide such a novel device for damming insulation which can be interlocked together substantially without the necessity of tools.

It is further an object of the present invention to provide such a novel device for damming insulation which is sold in a standard length and can be formed into an enclosure having a perimeter less than, substantially equal to, or greater than the standard sold length without the necessity of cutting the device.

These and further objects and advantages of the present invention will become clearer in light of the following detailed description of an illustrative embodiment of this invention described in connection with the drawings.

DESCRIPTION OF THE DRAWINGS

The illustrative embodiment may best be described with reference to the accompanying drawings where.

Figure 1:
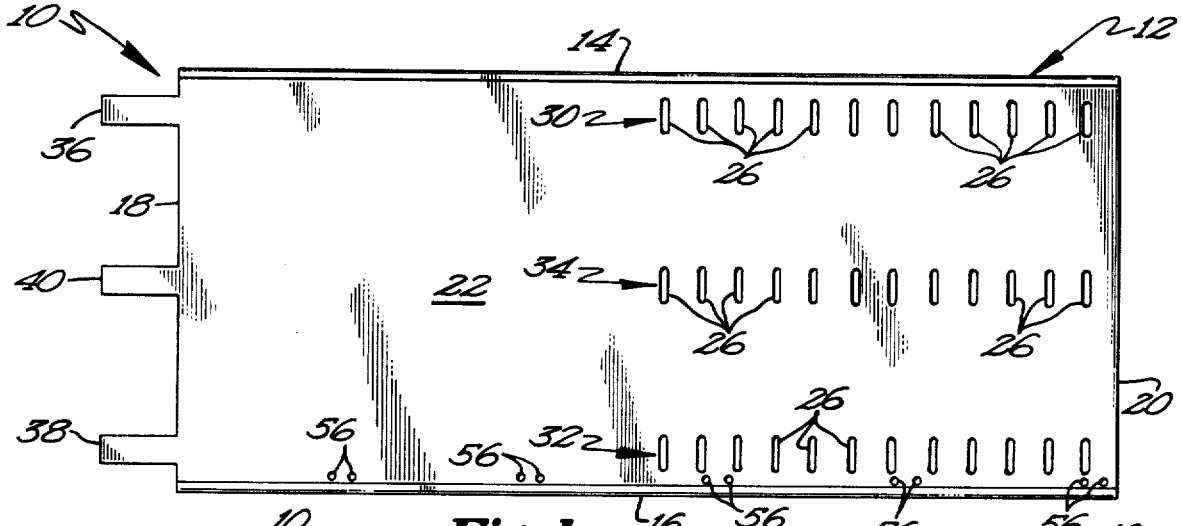
FIG. 1 shows a generally planar view of an insulation damming member utilized in forming the device for damming insulation according to the teachings of the present invention.

All figures are drawn for the ease of explanation of the basic teachings of the present invention only. Extensions of the figures with respect to number, position, relationship, and dimensions of the parts to form the preferred embodiment will be explained or will be within the skill of the art after the following teachings of the present invention have been read and understood.

Where used in the various figures of the drawings, the same numerals designate the same or similar parts in the insulation damming device. Furthermore, when the terms "first", "second", "top", "bottom", "middle", and similar terms are used herein, it should be understood that these terms have reference only to the structure shown in the drawings as it would appear to a person viewing the drawings and are utilized only to facilitate describing the invention.

DESCRIPTION

Referring to the drawings, a device for damming material around and away from an object according to the teachings of the present invention is shown and generally indicated as 10. The material can be of various compositions and structures, and the present invention is especially adapted for use in damming insulation around and away from heat producing objects. Specifically, insulation can be either of the loose or batt type and can be composed of glass fiber, rock wool, or cellulose or many other varieties. Device 10 can prevent insulation from contacting potentially hazardous heat producing objects such as round or square recessed light fixtures, exhaust flues of furnaces, fireplaces, and chimneys, or furnaces. Furthermore, device 10 can be utilized to prevent insulation from contacting other objects such as kitchen and bathroom exhaust fans or attic fans.

Device 10 includes at least one panel or material damming member 12. Damming member 12 is a generally planar sheet member and includes a top edge 14, a bottom edge 16, a first end edge 18, a second end edge 20, a first surface 22, and a second surface 24. Edges 14 and 16 are shown as hemmed for safety to protect against cuts to the users of member 12 during installation. The vertical height of material damming member 12 is defined by the distance between edges 14 and 16. The length of member 12 is defined by the distance between edges 18 and 20. In the preferred embodiment, members 12 have a standard height and length for their manufacture, use, and sale. In other words, in the preferred embodiment, members 12 may be manufactured at a single fixed length which is standard for all members 12 and are sold having this fixed length, hereinafter, its standard sold length. Furthermore, as described hereinbefore and hereinafter, members 12 are utilized in forming device 10 substantially without the necessity of cutting members 12 and thus are used in its standard sold length. Member 12 preferrably should be made of light, strong, fireproof, rotproof, corrosion-resistant, vermin-proof, dimensionally stable material. In the preferred embodiment, member 12 is made of aluminum having a thickness between surfaces 22 and 24 of 0.013 to 0.015 inches, a height of 15 inches, and a length of 33 inches.

Figure 2:
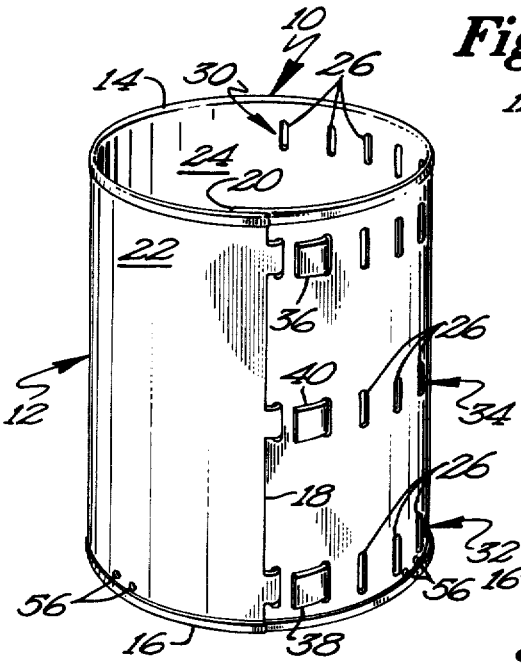
FIG. 2 shows a perspective view of one form of a device for damming insulation according to the teachings of the present invention.
Figure 3:
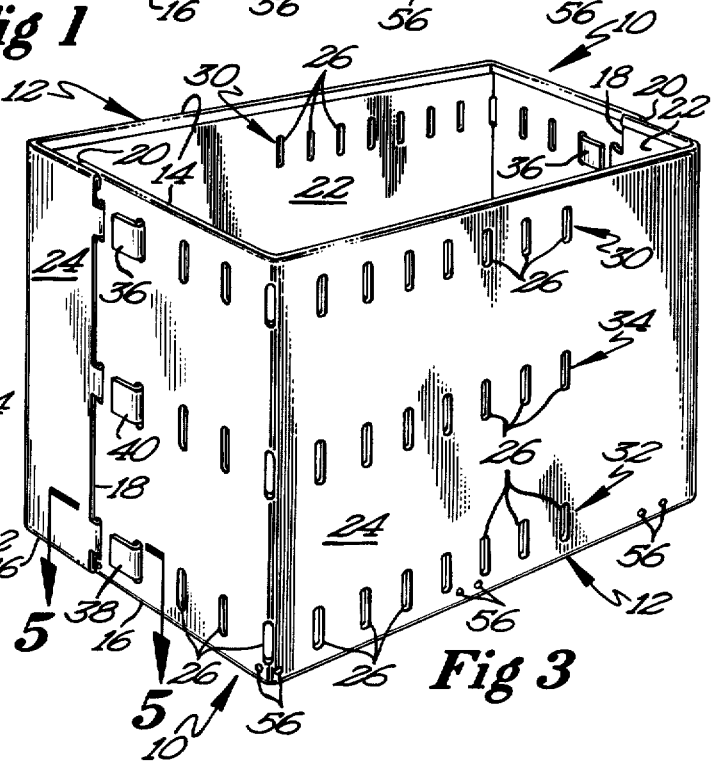
FIG. 3 shows a perspective view of another form of a device for damming insulation according to the teachings of the present invention.
Figure 4:
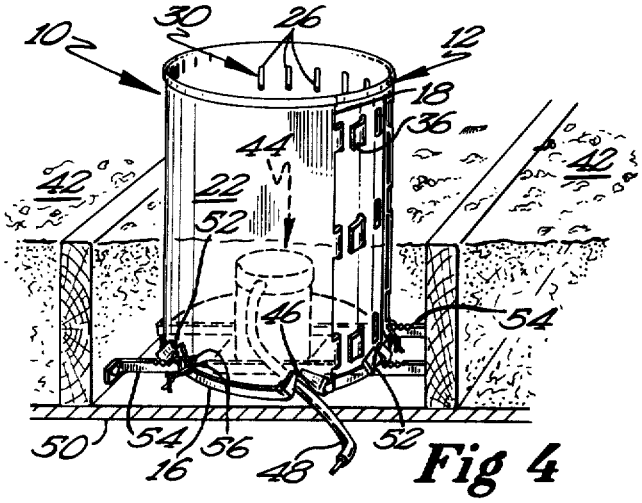
FIG. 4 shows a perspective view of the insulation damming device of FIG. 2 in use according to the teachings of the present invention.

Damming member 12 further includes members which are integrally formed on member 12 for forming enclosures of different perimeters or sizes utilizing one or more members 12. When formed into an enclosure as shown in FIGS. 2–4, damming members 12 can be placed around an object allowing the material to be filled around the object such that damming member 12 acts as a dam in preventing the material from filling in around the object.

In the preferred embodiment, the enclosure forming members include a series of slots 26 extending through surfaces 22 and 24. In the preferred embodiment, member 12 includes a top row 30 of slots 26 located adjacent edge 14, a bottom row 32 of slots 26 located adjacent edge 16, and middle row 34 of slots 26 located vertically midway between edges 14 and 16. Rows 30, 32, and 34 of slots 26 extend from adjacent edge 20 to the longitudinal midpoint of member 12, or in other words, a point midway between edges 18 and 20.

Member 12 further includes members which attach to and cooperate with slots 26, shown in the preferred embodiment as a top extension member 36 which associates and cooperates with row 30 of slots 26, a bottom extension member 38 which associates and cooperates with row 32 of slots 26, and a middle extension member 40 which associates and cooperates with row 34 of slots 26. Members 36, 38, and 40 are elongated fingers or tab members attached to and extending from edge 18 of member 12 having lengths approximately equal to 3 inches and heights approximately equal to $\frac{7}{8}$ inch. Slots 26 have heights approximately equal to 1 inch and widths of approximately $\frac{1}{8}$ inch and are spaced approximately $1\frac{1}{4}$ inches apart. In the preferred embodiment, rows 30, 32, and 36 include 12 slots.

Figure 5:
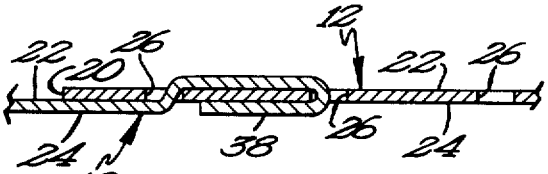
FIG. 5 shows a cross-sectional view of the device of FIG. 3 according to Section Line 5—5 in FIG. 3.

Members 36, 38, and 40 and slots 36 can be interconnected to form a positive belt loop, finger locking type interlock as best seen in FIG. 5. Specifically, members 36, 38, and 40 can be inserted into corresponding first slots 26 of rows 30, 32, and 34, and passed through and bent or hooked around the adjacent slots 26 of rows 30, 32, and 34, respectively, as best seed in FIG. 5. It should then be noted that the belt loop type interconnect of the present invention provides a stronger interconnection than if members 36, 38, and 40 were bent or hooked around a single slot 26 in rows 30, 32, and 34, respectively. Furthermore, it should be noted that members 36, 38, and 40 can be inserted into slots 26 such that the free ends thereof are located either on the inside or the outside of the enclosure.

It should then be further noted that members 36, 38, and 40 can be interconnected to slots 26 formed in the same damming member 12 in which they are also formed, as best seen in FIG. 2, or can be interconnected to slots 26 of another damming member 12 to form a larger enclosure made up of more than one damming member 12 connected together, as best seen in FIG. 3. Furthermore, members 36, 38, and 40 can be interconnected to any of the desired slots 26 in the series of slots 26 of rows 30, 32, and 34, respectively, allowing device 10 to be made of various perimeters. For example, members 36, 38, and 40 could extend through first and second slots 16 adjacent edge 20 of rows 30, 32, and 34, respectively, if the largest perimeter is desired or could extend through the first and second slots 26 adjacent the end of rows 30, 32, and 34 at the midpoint of member 12, if the smallest perimeter is desired.

The extremely versatile nature of device 10 according to the teachings of the present invention can now be appreciated. For example, if device 10 is desired to have a perimeter equal to one and one half times the standard sold length, members 36, 38, and 40 can be interconnected in slots 26 in several methods. A first method would be to have members 36, 38, and 40 of a first damming member 12 interconnect with the first and second slots 26 adjacent edge 20 of rows 30, 32, and 34, respectively, of the second damming member 12 and have members 36, 38, and 40 of the second damming membber 12 interconnect with the first and second slots 26 adjacent the end of rows 30, 32, and 34 at the midpoint of the first damming member 12. A second method would be to have members 36, 38, and 40 of the first and second damming members 12 interconnect with slots 26 of rows 30, 32, and 34 located at three fourths the length of second and first damming member 12, respectively. It can also be appreciated that members 12 can be interconnected in similar methods between the first and second methods such that the combined lengths equal the desired perimeter of one and one half times the standard sold length. Thus, one or more damming members 12 can be interconnected to span any distance around an object such as a recessed light fixture, with the minimum distance being equal to the length of slots 26 away from edge 18.

Additionally, device 10 can be shaped to correspond to the enclosed object. Specifically, members 12 can be bent by laying an elongated member across member 12, preferrably perpendicular to edges 14 and 16 and generally parallel to edges 18 and 20, and by bending member 12 along the elongated member to the desired angle. The elongated member can be any suitable stiff member having a generally straight edge, such as a board, steel rule, or bending bar.

Thus, with the ability to be bent to the desired shape and to be made of various perimeters, device 10 can be easily shaped and interconnected to have a perimeter corresponding to the perimeter of the object desired to be enclosed and thus to fit around any size and shape object desired. For example, device 10 is shown in FIG. 2 for fitting around a round object while device 10 is shown in FIG. 3 for fitting around a rectangular-shaped object.

The preferred use of device 10 according to the teachings of the present invention is shown in FIG. 4 for damming insulation 42 away from light fixture 44. Edge 16 can be notched, as at 46, to allow electrical wire 48 for electrical connection with fixture 44 to pass therethrough and yet allow edge 16 to lie flat on support surface 50 such as the ceiling shown in FIG. 4. Edges of notch 46 can then be rolled or turned outward as shown in FIG. 4 to prevent the edges of notch 46 from cutting or damaging wire 48. Similarly, edge 16 can be notched as at 52 to allow fixture supporting members 54 to pass therethrough such that edge 16 yet lies flat on support surface 50.

Since edge 16 lies flat on surface 50, device 10 is very stable and resists tipping or other movement due to the large contact space and will be held firmly in place since the insulation will apply equal pressure on all sides of device 10. For increased stability and position retention, pairs of apertures 56 are provided adjacent to edge 16 for receiving wire which may be secured to any suitable support such as member 54 shown in FIG. 4.

Furthermore, device 10 can be secured to a brace member, if available, by any other suitable securement methods such as nailing. For example, where fixture 44 is pinned to a cross brace, device 10 can be notched to straddle the cross brace and the flanges created by the notches in device 10 can be secured to the cross brace such as by nailing.

It can then be appreciated that it is desired to have the maximum amount of insulation to prevent heat transfer. However, to prevent fire which may result if heat is entrapped by insulation around heat sources, the insulation must be spaced from the heat source to allow free circulation around the heat source. Under present building codes, a 3 inch clearance is required from the heat source. With the ability to be shaped around any size or shape heat source, device 10 maximizes the amount of insulation space available but still insures proper clearance between all points of the heat source to prevent fires. In the prior art, some insulation damming of shielding devices utilized only straight members which did not conform to the shape of the heat source and thus reduced the insulation space available at least in the enclosure corners.

Further, it can be appreciated that device 10 according to the teachings of the present invention can be quickly and easily installed and does not require the use of clips or other non-integral fastening devices which are easy to lose. Device 10 is very versatile being usable for new construction, remodelling, or retrofitting. Due to its tall height, device 10 prevents overspill of insulation over the top.

Additionally, due to the positive, 3-position belt loop type of interconnection of members 36, 38, and 40 with slots 26, bulging of device 10 is prevented, especially at the vertical center, which could allow insulation to escape therethrough as occurred in the prior art where connection was made only at the edges by clips and no connection was made in the center.

It can be appreciated that according to the teachings of the present invention, one or more damming members 12 can be easily and quickly interconnected without the use of tools and without cutting members 12 to form an enclosure having a perimeter less than the standard sold length when members 36, 38, and 40 are interconnected to slots 26 spaced from edge 20 in the same member 12, having a perimeter substantially equal to the standard sold length when members 36, 38, and 40 are interconnected to slots 26 adjacent edge 20 in the same member 12, or having a perimeter greater than the standard sold length when two or more members 12 are interconnected using members 36, 38, and 40 and slots 26. Thus, device 10 according to the teachings of the present invention allows for fast, versatile, and easy installation.

Now that the basic teachings of the present invention have been explained, many extensions and variations will be obvious to one having ordinary skill in the art. For example, apertures 56 can be provided adjacent to edge 14 in addition to edge 16 allowing reversal of member 12 such that either edges 14 or 16 can be abutted with support surface 50.

In the preferred embodiment, slots 26 extend approximately midway of the length of member 12. Thus, 2 or more members 12 can be interconnected to form an enclosure having a perimeter of any size greater than the length of member 12. However, if it is desired to to form enclosures having a perimeter less than one-half the length of member 12, slots 26 can be extended towards edge 18.

Thus, since the invention disclosed herein may be embodied in other specific forms without departing from the spirit or general characteristics thereof, some of which forms have been indicated, the embodiments described herein are to be considered in all respects illustrative and not restricted. The scope of the invention is indicated by the appended claims rather than by the foregoing description and all changes which come within the meaning and range of equivalency of the claims are intended to be embraced therein.

I claim:

1. Device for damming insulation around and away from a heat producing object, such as a recessed light fixture, and for preventing the insulation from contacting the heat producing object, comprising, in combination: an insulation damming member formed of generally planar sheet metal and having a top edge, a bottom edge, a first end edge, a second end edge, a first surface, and a second surface, with the height of the damming member being defined by the distance between the top edge and the bottom edge, with the damming member having a standard sold length defined by the distance between the first end edge and the second end edge; a top series of slots located adjacent the top edge of the damming member; a bottom series of slots located adjacent the bottom edge of the damming member; a middle series of slots located midway between the top and bottom edges of the damming member, with the top, bottom, and middle series of slots formed through the first and second surfaces of the damming member and extending along a length of the damming member from the second end edge; a top extension member associated with the top series of slots and extending from the first end edge of the damming member; a bottom extension member associated with the bottom series of slots and extending from the first end edge of the damming member; a middle extension member associated with middle series of slots and extending from the first end edge of the damming member, with the top, bottom, and middle extension members being interconnectable to the slots in a positive belt loop, finger locking type interconnection wherein the extension members may be inserted in one of the slots of the series of slots and passed through and hooked around the adjacent slot in the series of slots to form the damming member into an enclosure of a size to fit around the heat producing object without the necessity of tools or without cutting the damming member and allowing the perimeter of the enclosure to be substantially equal to the length of the damming member or less than the length of the damming member whereby the damming member can be easily and quickly formed into an enclosure having a perimeter less than or substantially equal to the standard sold length of the damming member allowing the fast, versatile, and easy installation of the insulation damming device.

2. The device of claim 1 further comprising, in combination: at least a second insulation damming member formed of generally planar sheet metal and having a top edge, a bottom edge, a first end edge, a second end edge, a first surface, and a second surface, with the height of the second damming member being defined by the distance between the top edge and the bottom edge, with the second damming member having a standard sold length defined by the distance between the first end edge and the second end edge, with the height of the first damming member being equal to the height of the second damming member and with the length of the first damming member being equal to the length of the second damming member; a top series of slots located adjacent the top edge of the second damming member; a bottom series of slots located adjacent the bottom edge of the second damming member; a middle series of slots located midway between the top and bottom edges of the second damming member, with the top, bottom, and middle series of slots formed through the first and second surfaces of the second damming member and extending along a length of the second damming member from the second end edge; a top extension member associated with the top series of slots and extending from the first end edge of the second damming member; a bottom extension member associated with the bottom series of slots and extending from the first end edge of the second damming member; a middle extension member associated with the middle series of slots and extending from the first end edge of the second damming member; with the extension members and slots forming a positive belt loop, finger locking type interconnection where the extension members are inserted in a slot of the series of slots and passed through and hooked around the adjacent slot in the series of slots and wherein the extension members of the first damming member are interconnected with the series of slots of the second damming member and the extension members of the second damming member are interconnected with the slots of the first damming member to form an enclosure having a perimeter greater than the standard sold length of the damming member whereby the first and second damming members can be easily and quickly formed into an enclosure having a perimeter greater than the standard sold length of the damming members allowing the fast, versatile, and many installation of the insulation damming device.

3. Device for damming insulation around and away from a heat producing object such as a recessed light fixture, for preventing the insulation from contacting the heat producing object, comprising, in combination: at least a first insulation damming member, with the damming member being generally planar and having a top edge, a bottom edge, a first end edge, a second end edge, a first surface, and a second surface, with the height of the damming member being defined by the distance between the top edge and the bottom edge, with the damming member having a standard sold length defined by the distance between the first end edge and the second end edge; and means for interconnecting the damming member together to form an enclosure of a size to fit around the heat producing object without the necessity of tools or without cutting the damming member, with the formed enclosure having a perimeter, having an open top defined by the top edge of the damming member, and having an open bottom defined by the bottom edge of the damming member, with the enclosure forming means being integral on the damming member without requiring other separate enclosure fastening members such as clips, with the enclosure forming means comprising, in combination: at least a first series of slots formed through the first and second surfaces and extending along a length of the damming member from the second end edge; and means located on the first end edge for cooperating and interconnecting with at least a selected slot allowing the perimeter of the enclosure to be substantially equal to the length of the damming member or less than the length of the damming member if one insulation damming member is interconnected to form an enclosure and allowing the perimeter to be greater than the length of the damming member when the enclosure is formed by two or more damming members having the cooperating and interconnecting means of one damming member interconnecting with the slots of the next damming member whereby the device can be easily and quickly formed into an enclosure having a perimeter less than, substantially equal to, or greater than the standard sold length of the damming member allowing the fast, versatile, and easy installation of the insulation damming device; wherein the cooperating of interconnecting means comprises at least a first extension member extending from the first end edge of the damming member for insertion into at least one slot of the series of slots; and wherein the extension member and slots form a positive belt loop, finger locking type interconnection with the extension member being inserted into a slot of the series of slots and passed through and hooked around the adjacent slot in the series of slots.

4. The device of claim 3 further comprising, in combination: a bottom series of slots located adjacent the bottom edge of the damming member; a middle series of slots located midway between the top and bottom edges of the damming member, with the first series of slots located adjacent the top edge of the damming member, with the cooperating and interconnecting means further comprising, in combination: a bottom extension member extending from the first end edge of the damming member, and a middle extension member extending from the first end edge of the damming member, with the first extension member being associated with the first series of slots, with the bottom extension member being associated with the bottom series of slots, and with the middle extension member being associated with the middle series of slots.

5. Device for damming insulation around and away from a heat producing object such as a recessed light fixture, for preventing the insulation from contacting the heat producing objects, comprising, in combination: at least a first insulation damming member, with the damming member being generally planar and having a top edge, a bottom edge, a first end edge, a second end edge, a first surface, and a second surface, with the height of the damming member being defined by the distance between the top edge and the bottom edge, with the damming member having a standard sold length defined by the distance between the first end edge and the second end edge; and means for interconnecting the damming member together to form an enclosure of a size to fit around the heat producing objects without the necessity of tools or without cutting the damming member, with the formed enclosure having a perimeter, having an open top defined by the top edge of the damming member, and having an open bottom defined by the bottom edge of the damming member, with the enclosure forming means being integral on the damming member without requiring other separate enclosure fastening members such as clips, with the enclosure forming means comprising, in combination: at least a first series of slots formed through the first and second surfaces and extending along a length of the damming member from the second end edge; and means located on the first end edge for cooperating and interconnecting with at least a selected slot allowing the perimeter of the enclosure to be substantially equal to the length of the damming member or less than the length of the damming member if one insulation damming member is interconnected to form an enclosure and allowing the perimeter to be greater than the length of the damming member when the enclosure is formed by two or more damming members having the cooperating and interconnecting means of one damming member interconnecting with the slots of the next damming member whereby the device can be easily and quickly formed into an enclosure having a perimeter less than, substantially equal to, or greater than the standard sold length of the damming member allowing the fast, versatile, and easy installation of the insulation damming device; and means for providing increased stability and position retention comprising first and second apertures formed in the damming member adjacent to the bottom edge for receiving a wire for attachment to a support member.

6. The device of claim 3 wherein the damming member is bent along an elongated member having a straight edge laid on the damming member generally parallel to the end edges allowing the perimeter of the enclosure to have a shape corresponding to and to fit around the heat producing object.

7. The device of claim 3 wherein the bottom edge is notched to allow electrical connection to the heat producing object to pass therethrough, with the edges of the notch being rolled to prevent the notch from cutting or damaging the electrical connection.

8. The device of claim 3 wherein the top edge and the bottom edge of the damming member are hemmed to protect against cuts to the users of the insulation damming device during installation.

* * * * *